US007040674B2

(12) United States Patent
Lomicka et al.

(10) Patent No.: US 7,040,674 B2
(45) Date of Patent: May 9, 2006

(54) POWERED LATCH ASSEMBLY

(75) Inventors: Joe Lomicka, La Verne, CA (US); Zhirong Wang, La Verne, CA (US); Min Zhao, Shanghai (CN); Wei Xu, La Verne, CA (US); Lijun Lu, La Verne, CA (US)

(73) Assignee: HTI Technology & Industries, Corp, La Verne, CA (US)

( * ) Notice: Subject to any disclaimer, the term of this patent is extended or adjusted under 35 U.S.C. 154(b) by 135 days.

(21) Appl. No.: 10/775,533

(22) Filed: Feb. 9, 2004

(65) Prior Publication Data

US 2005/0173932 A1 Aug. 11, 2005

(51) Int. Cl.
*E05C 3/06* (2006.01)

(52) U.S. Cl. ..... 292/201; 292/216

(58) Field of Classification Search ..... 292/201, 292/216

See application file for complete search history.

(56) References Cited

U.S. PATENT DOCUMENTS

| | | | | |
|---|---|---|---|---|
| 4,776,619 | A * | 10/1988 | Daugherty et al. | 292/201 |
| 4,838,586 | A * | 6/1989 | Henne | 292/113 |
| 5,029,910 | A * | 7/1991 | Genbauffe et al. | 292/110 |
| 5,284,378 | A * | 2/1994 | Sautter, Jr. | 296/224 |
| 5,493,099 | A * | 2/1996 | McWilliams, III | 219/413 |
| 6,758,511 | B1 * | 7/2004 | Taylor et al. | 296/121 |

* cited by examiner

*Primary Examiner*—Gary Estremsky
(74) *Attorney, Agent, or Firm*—Raymond Y. Chan; David & Raymond

(57) ABSTRACT

A power latch assembly which includes a supporting frame adapted for mounting on a main housing, wherein the supporting frame has a locking slot and defines first and second slider ends thereof; a motor assembly including a power motor supported by the supporting base and adapted for being powered by the main housing, and a driving arm driven by the power motor in a linear movable manner; and a locking latch, defining a first guiding edge and a second guiding edge, having an inner coupling end coupling with the driving arm and an opposed latching end extended outwardly through the locking slot, wherein the driving arm drives the locking latch between a locking position and an unlocked position.

31 Claims, 9 Drawing Sheets

POWERED LATCH ASSEMBLY

BACKGROUND OF THE PRESENT INVENTION

1. Field of Invention

The present invention relates to a door latch, and more particularly to a powered latch assembly which is capable of converting a rotational driving force delivered by a power source, such as a motor or a solenoid, to a linear movement of a locking latch for locking a door of an enclosure, such as an oven door or sky lights etc.

2. Description of Related Arts

Conventional powered latch assemblies are widely utilized for locking a door, such as an oven door, to a main housing, such as an oven body, for a wide variety of purposes.

For instances, ovens are widely utilized domestically, commercially and industrially. Domestically, small or medium scale ovens are used to cook variety of food. Commercially, medium scale or large scale ovens are utilized to provide catering services. Industrially, large and heavy-duty ovens are utilized for such typically process as heat treatment.

Whatever kind of ovens are utilized, a typical oven usually comprises a main housing having a heating chamber formed therein, an oven door movably connected to the case for closing the reaction chamber, and a heat generating device disposed in the main housing for generating a substantial amount of heat inside the reaction chamber. Thus, it is extremely dangerous for leaving the oven door unlocked, especially when the oven is on or is in a dangerous condition because, say, the temperature inside the reaction chamber is still high notwithstanding that the oven is turned off.

Because of this, various locking devices (very often electrically powered) for ovens have been developed for locking the oven doors to the main housing so that no one can open the oven door when it is on or is still in a dangerous condition.

U.S. Pat. No. 6,315,336 of Swartzell discloses motorized self-cleaning oven latch in which the oven latch comprises a base, a pivot mounted on the base, a latch arm having a slot formed therein, the slot engaging the pivot and the latch arm sliding and rotating relative to the pivot, a motor, a cam rotatably driven by the motor from a first position to a second position, and a metal wire connected to the cam and the latch arm, the metal wire sliding and rotating the latch arm from an open position to a closed position as the cam rotates from the first position to the second position.

There are two major problems for this conventional art. First, no positive feedback is provided for indicating the door position. That means when the door is not fully closed with respect to the oven body, the oven latch has no way to know and subsequent attempt to lock up the door will fail, leaving the oven, and ultimately the user, being unaware the unsafe state of the oven door, in a dangerous condition.

Second, from the disclosed embodiments, one skill in the art would easily realize that the metal wire connecting the cam and the latch arm is an important element, any damages or distortions thereof invite total failure of the whole oven latch. Thus, it is of overriding important to keep the metal wire in question strong and durable in order to keep the oven latch in a good working condition. From the disclosed embodiments, no such features can reasonably be observed.

Several other types of latches have been developed. For example, U.S. Pat. No. 6,474,702 of Malone discloses a particular type of latch assemblies. As shown in the patent, that latch assembly employs pivotal movement of the latching arms for locking the oven door to the respective oven body. The pivotal movement of the latching arms is driven by a motor through some sorts of pivotal transmission arrangements. Those transmission arrangements are typically complicated in structure and numerous in components involved so that the possibility of getting defective is higher, in that failure of any one of those numerous components would lead to failure of the whole latch assembly.

SUMMARY OF THE PRESENT INVENTION

A main object of the present invention is to provide a powered latch assembly for locking a door, such as an oven door, to a main housing, such as an oven body, wherein the powered latch assembly comprises a power source which is arranged to drive a driving arm in a linear movable manner for pivotally and linearly driving a locking latch to lock up the door to the main housing.

Another object of the present invention is to provide a powered latch assembly for locking a door, such as an oven door, to a main housing, such as an oven body, wherein the driving arm of the power latch assembly is not only strong in strength, but also simple in structure, so as to substantially overcome the above-mentioned discrepancies which exist in conventional lock assemblies.

Another object of the present invention is to provide a powered latch assembly for locking a door, such as an oven door, to a main housing, such as an oven body, wherein the power latch assembly comprises a feedback device which is adapted to detect the operation of the locking latch and provide an appropriate feedback for remedying the situation if locking latch is not functioning properly.

Another object of the present invention is to provide a powered latch assembly for locking a door, such as an oven door, to a main housing, such as an oven body, wherein the powered latch assembly is capable of manually pulling over immediately when the power supply thereto is accidentally cut off or fails, or other items fail.

Another object of the present invention is to provide a powered latch assembly for locking a door, such as an oven door, to a main housing, such as an oven body, wherein the power latch assembly contains less part as compared with conventional power latch assemblies, and made by simple and durable structure so as to ensure reliable operation.

Another object of the present invention is to provide a powered latch assembly for locking a door, such as an oven door, to a main housing, such as an oven body, wherein the power latch assembly does not involve any complicated or expensive components so as to minimize the manufacturing cost and the ultimate selling price of the present invention.

Accordingly, in order to accomplish the above objects, the present invention provides a powered latch assembly for locking a door having a lock engaging slot to a main housing, comprising:

a supporting frame adapted for mounting on said main housing, wherein said supporting frame has a locking slot and defines first and second slider ends thereof;

a power source comprising a motor assembly supported by said supporting base and adapted for being powered by said main housing, and a driving arm driven by said motor assembly in a linear movable manner; and a locking latch, defining a first guiding edge and a second guiding edge, having an inner coupling end coupling with said driving arm and an opposed latching end extended outwardly through said locking slot, wherein said driving arm linearly drives said locking latch moving between a locking position and an unlocked position, wherein at said locking position, said first guiding edge of said locking latch is guided to slide on said first slider end of said locking slot to pivotally and linearly move said locking latch to engage with said lock engaging slot of said door for locking up said door with said main housing, and at said unlocked position, said second guiding edge of said locking latch is guided to slide on said second slider end of said locking slot to pivotally and linearly move said locking latch to disengage with said lock engaging slot of said door for unlocking said door with said main housing.

These and other objectives, features, and advantages of the present invention will become apparent from the following detailed description, the accompanying drawings, and the appended claims.

DETAILED DESCRIPTION OF THE PREFERRED EMBODIMENT

Figure 1:
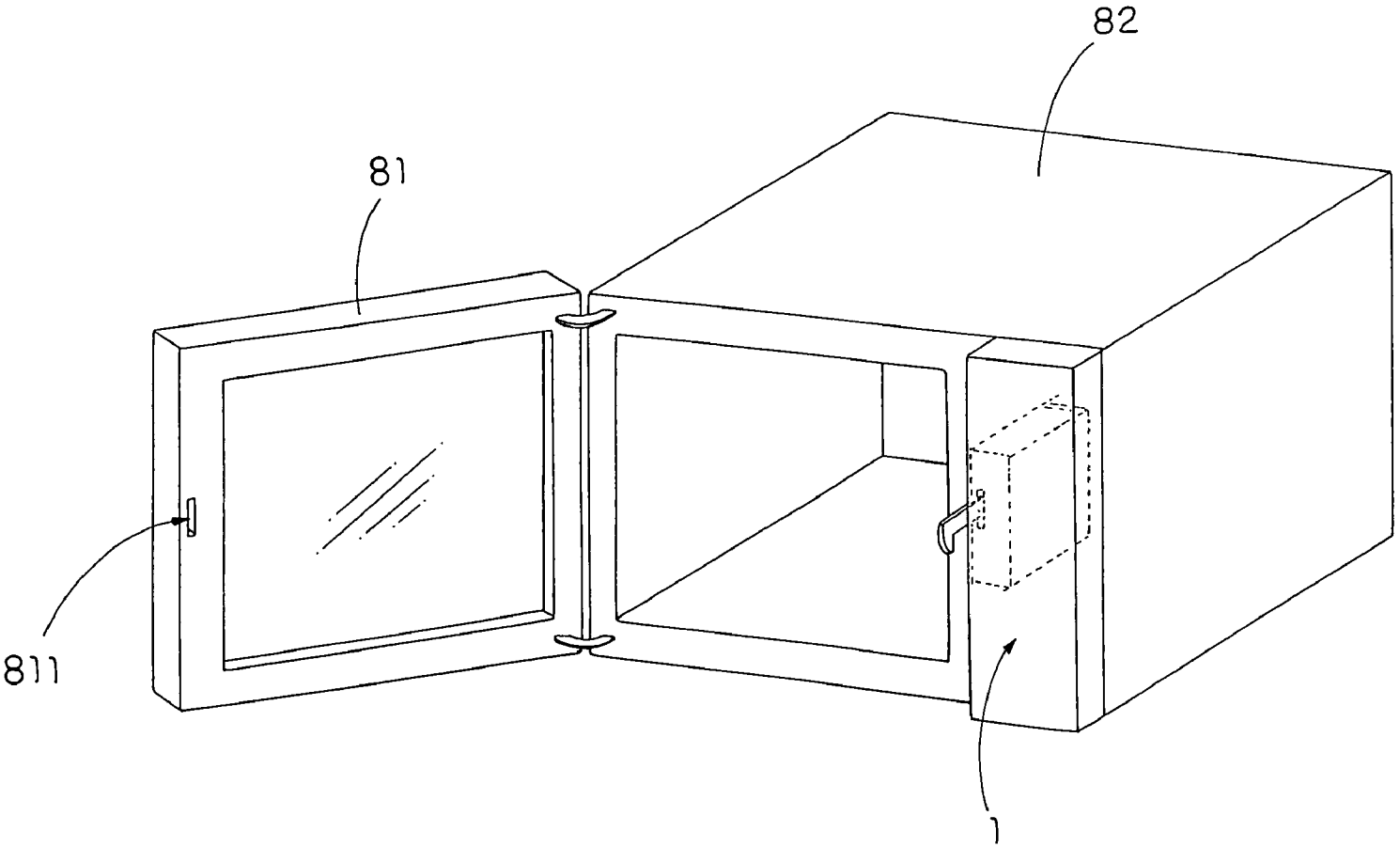
FIG. 1 is a perspective view of a powered latch assembly incorporated with an oven according to a preferred embodiment of the present invention.

Referring to FIG. 1 of the drawings, a power lock assembly 1 for locking a door 81, such as an oven door 81 having a lock engaging slot 811 or a engaging socket, pin, etc., to a main housing 82, such as an oven body or an enclosure, is illustrated, in which the power lock assembly 1 comprises a supporting frame 10, a power source, such as a motor assembly 20 or a solenoid, and a locking latch 30.

Figure 2:
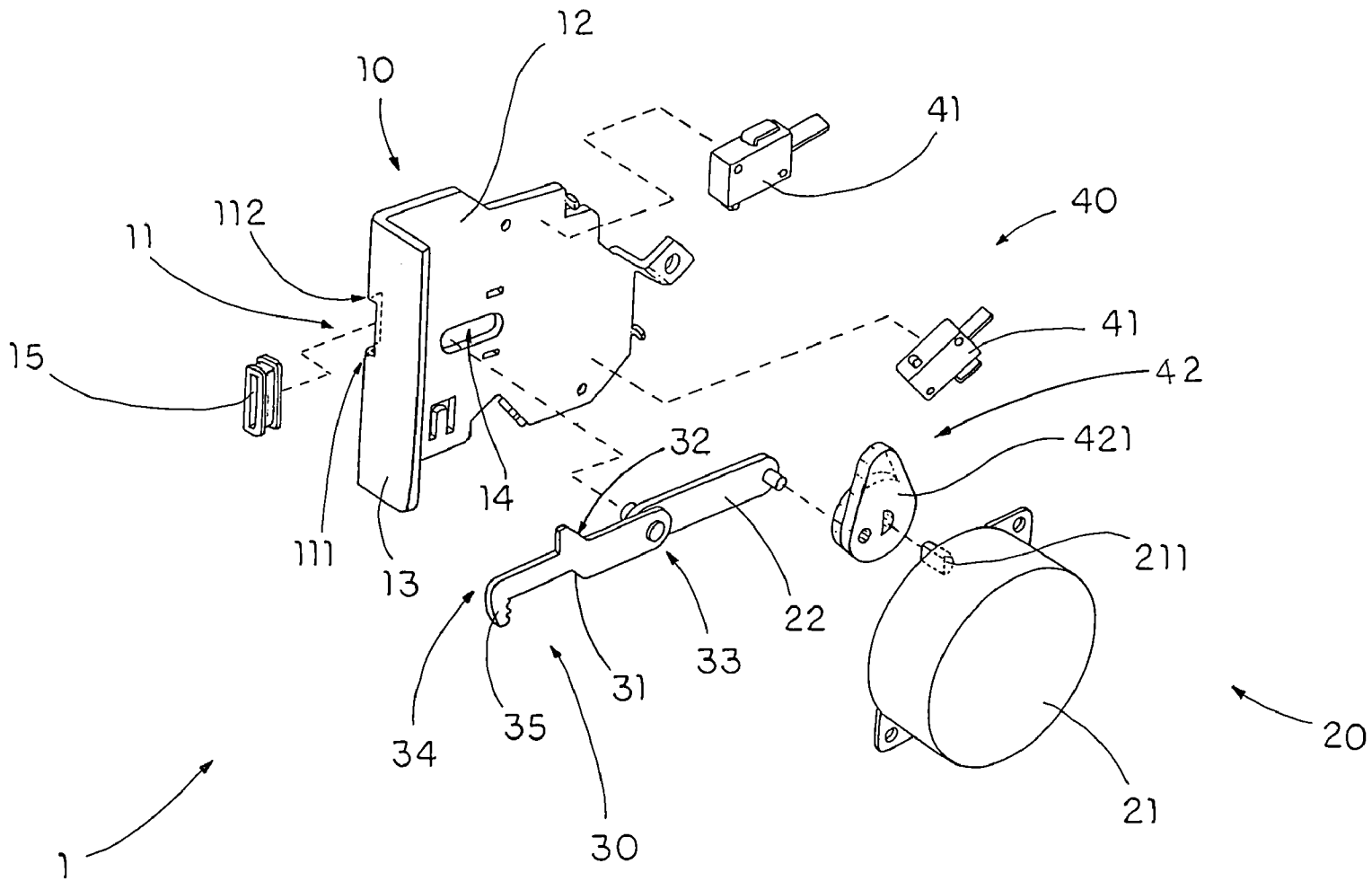
FIG. 2 is an exploded perspective view of the powered latch assembly according to the above first preferred embodiment of the present invention.

Referring to FIG. 2 of the drawings, the supporting frame 10 is adapted for mounting on the main housing 82, such as the oven body, and contains a locking slot 11 formed thereon to define first and second slider ends 111, 112 of the locking slot 11. The supporting frame 10 comprises a supporting base 12, and a sidewall 13 outwardly and integrally extended therefrom in which the locking slot 11 is longitudinally formed on the sidewall 12.

The motor assembly 20 comprises a motor 21, such as an Alternating Current (AC) motor, a Direct Current (DC) motor or a gear motor, supported on the supporting base 12 and adapted for being powered up by the main housing 82, such as the oven, and a driving arm 22 arranged to be driven by the motor 21 in a linearly movable manner.

Figure 3A:
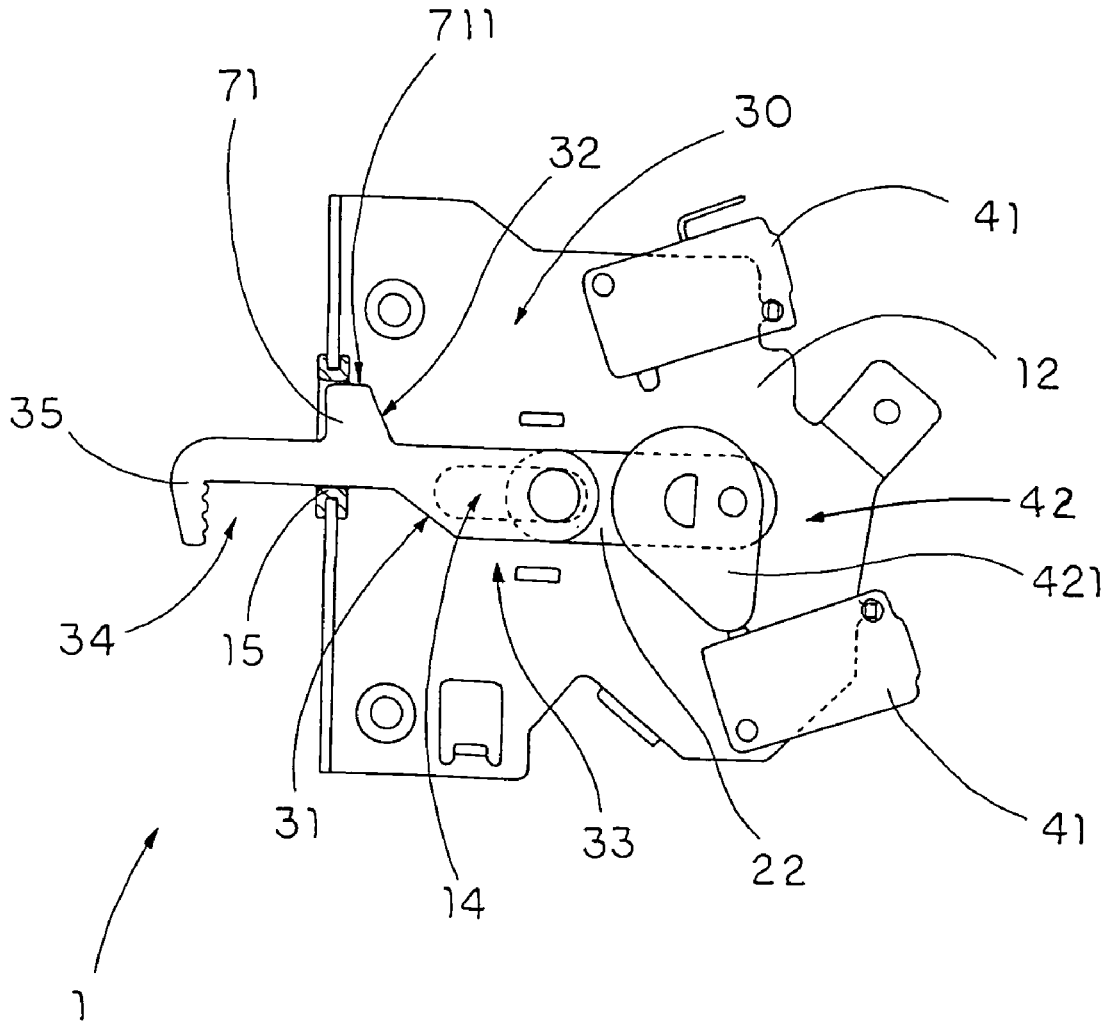
FIG. 3A is a schematic diagram of the powered latch assembly according to the above first preferred embodiment of the present invention, illustrating that the locking latch is in a locking position.
Figure 3B:
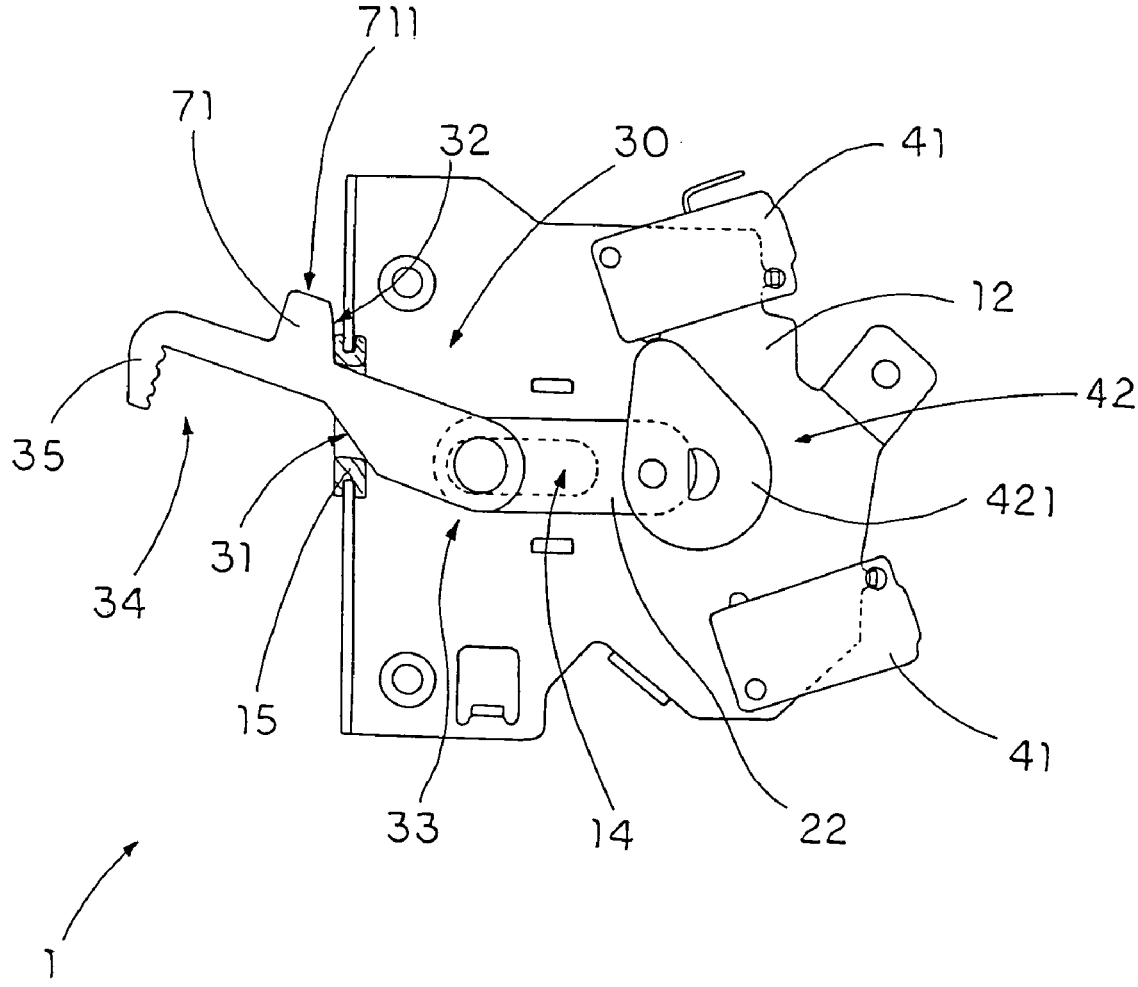
FIG. 3B is a schematic diagram of the powered latch assembly according to the above first preferred embodiment of the present invention, illustrating that the locking latch is in an unlocked position.

The locking latch 30, defining a first guiding edge 31 and a second guiding edge 32, has an inner coupling end 33 coupled with the an outer end portion of the driving arm 22, and an opposed latching end 34 outwardly extended to an outside of the supporting frame 10 through the locking slot 11, wherein the driving arm 22 is arranged to drive the locking latch 30 slidably moving along the locking slot 11 between a locking position and an unlocked position, wherein in the unlocking position, the first guiding edge 31 of the locking latch 30 is guided to slide on the first slider end 111 of the locking slot 11 to linearly and then pivotally move for pulling the locking latch 30 to engage with the lock engaging slot 811 of the door 81 for locking the door 81 with respect to the main housing 82, as shown in FIG. 3A of the drawings, wherein at the locked position, the second guiding edge 32 is guided to slide on the second slider end 112 of the locking slot 11 to linearly and then pivotally move for pushing the locking latch 30 to disengage with the lock engaging slot 811 of the door 81 for unlocking the door 81 with respect to the main housing 82, as shown in FIG. 3B of the drawings.

Referring to FIG. 2, FIG. 3A and FIG. 3B of the drawings, the motor assembly 20 further comprises a driving axle 211 rotatably extended therefrom wherein an inner end portion of the driving arm 22 is pivotally connected with the driving axle 211. Moreover, the supporting frame 10 further has a guiding slot 14 longitudinally formed on the supporting base 12 wherein the driving arm 22 is mounted to the guiding slot 14 in a linearly slidable manner such that a linear locus of the driving arm 22 is substantially guided by the guiding slot 14. In other words, when the power motor 21 starts to rotate, the driving arm 22 is then driven to move linearly with respect to the guiding slot 14.

According to the first preferred embodiment, a width of the locking slot 11 is made slightly larger than a thickness of the locking latch 30 such that a lateral movement between the locking latch 30 and the supporting frame 10 could be substantially restricted. In other words, there requires a minimum number of components mounting the driving arm 22 to the guiding slot 14 in the linearly movable manner. That also means that a common disadvantage for typical mounting methods, such as screwing, which usually causes a little protrusion outwardly extended from the bottom side of the supporting frame 10, can be got rid of. As a result, the supporting frame 10 is adapted to be fittedly mounted on any surface of the fixed housing 82.

According to the first preferred embodiment, the locking latch 30 is elongated in shape wherein the first and the second guiding edges 31, 32 are inclinedly formed on a first guided portion and a second guided portion of the locking latch 30 respectively and adapted to guide the first and the second slider ends 111, 112 respectively for sliding along the locking latch 30 in order to move between the locking position and the unlocked position. Therefore, a first and a second inclined angle for the first and the second guiding edges 31, 32 respectively dictate the extent to which the locking latch 30 is to be pivotally moved, whereas a length of the locking slot 11 limits the maximum possible pivotal movement of the locking latch 30. Moreover, a distance of the pivotal movement of the locking latch 30 from the unlocked position to the locking position is ultimately determined by a surface profile of the first guiding edge 311 and the second guiding edge 312.

In order to smooth the locking and unlocking operation of the powered latch assembly 1, the supporting frame 10 further comprises a guiding holder 15 which is fabricated from a kind of material having a low coefficient of fiction, and peripherally and detachably mounted on a side boundary of the locking slot 11 to form the first and the second slider end 111, 112. Therefore, when the guiding holder 15 is about to be dissipated as a result of repeated operation of the powered latch assembly 1, it is adapted to be replaced for resuming an optimal performance of the powered latch assembly 1.

Moreover, the locking latch 30 further has a griping head 35, such as a hook, transversely formed on its latching end 34 and adapted for engaging with the lock engaging slot 811 of the door when the locking latch 30 is pivotally driven to the locking position so as to lock up the oven door to the oven body.

Thus it is worth mentioning that in order to fit a wide variety of, say, ovens, the length of the locking slot 11 and the inclined angles and the surface profile of the first and the second guiding edges 31, 32 can be varied in order to fit the actual circumstances in question.

It is important to point out that since the locking latch 30 is arranged to be pivotally and linearly driven to move between the locking position and the unlocked position, when the door 81 is not properly closed, the locking latch 30 may be incapable of being pulled to securely engage with the main housing 82. As a result, unusual acoustical noise may be generated from the power source, such as the motor 21, for indicating that the locking operation is improperly carried out.

Conversely, since the pivotally movement of the locking latch 30 is guided by the first and the second guiding edges 31, 32, therefore, until a predetermined length has been traveled as driven by the power source, the door 81 cannot be unlocked manually, thus providing the maximum security and protection to the user of the, say, oven.

Referring to FIG. 2, FIG. 3A and FIG. 3B of the drawings, the power latch assembly 1 further comprises a feedback device 40 provided on the supporting frame 10 and operatively communicated with the locking latch 30 in such a manner that it is adapted to monitor the movement and detect the position of the locking latch 30 during locking or unlocking. Moreover, when the position of the locking latch 30 is identified, a feedback signal is then sent back to the power source for response operation, such as turning off of the, say, oven.

The feedback device 40 comprises at least one sensor 41 mounted on a predetermined position on the supporting base 12 and electrically connected to the power source, and a feedback actuation arrangement 42 provided on the supporting base 12 and operatively communicated with the locking latch 30 in such a manner that when the locking latch 30 is moved into a predetermined position, such as the locking position and the unlocked position, the sensor 41 will be actuated by the feedback actuation arrangement 42 and a feedback signal is sent to the power source.

The sensor 41 is preferably embodied as a regular motion sensor having a depressible button (or a regular on-off switch) protruded therefrom, wherein when the depressible button is depressed, the sensor 41 is actuated to send a feedback signal to the power source.

Alternatively, the sensor 41 can be embodied as a conventional optical sensor wherein sensing light beam is continuously emitted therefrom in such a manner that when reflection pattern changes as a result of the movement of the locking latch 30, the sensor 41 is then actuated by the feedback actuation arrangement 42 for generating a feedback signal to the power source.

It is worth mentioning that other forms of sensors may be employed for detecting and monitoring the position of the locking latch 30.

According to the first preferred embodiment, the feedback actuation arrangement 42 comprises and an actuation rotor 421 rotatably connected with the driving axle 211 of the motor assembly 21 and outwardly protruded from said driving axle 211 in such a manner that when the driving axle 211 is driven to rotate, the actuation rotor 421 is also driven to rotate for actuating the sensor 41 to generate the feedback signal.

As an example, when the sensor 41, which is embodied as a typical motion sensor, is adapted to detect whether or not the locking latch 30 is in the locked position, the, it should be mounted in a position where the actuation rotor 421 is arranged to actuate the sensor 41 when the locking latch 30 is driven to the locked position. The feedback signal can be embodied as, say, activating the heating operation of the oven for a predetermined period of time. After the certain predetermined period of time, the motor assembly 21 may be re-powered again by the oven so as to drive the locking latch 30 from the locking position back to the unlocked position. In respect to this, a simple logic gate theory may be employed in the sensor 41 for detecting the position of the locking latch 30.

Alternatively, in order to increase the resolution to which the position of the locking latch 30 is monitored, two or more sensors 41 can be employed in order to detect the position of the locking latch 30 in a finer manner. As shown in FIG. 3A and FIG. 3B of the drawings, two sensors 41 are mounted on two predetermined positions on the supporting base 12 respectively for detecting whether or not the locking latch 30 has reached the respective position. As such, simple feedback logic can be utilized for operating, say, the oven, in cooperation with the feedback device 40.

According to the first preferred embodiment of the present invention, the powered latch assembly 1 further comprises a safety device comprising a biasing muscle 71 outwardly, integrally and transversely extended from the second guided portion of the locking latch 30 wherein the second guiding edge 32 is formed on the biasing muscle 71 for guiding the locking latch 30 moving between the locking position and the unlocked position. Moreover, the biasing muscle 71 has a biasing surface 711 arranged to align with the second slider end 112 of the locking slot 11 when the locking latch 30 is in the locked position, so as to restrict a pivotal movement of the locking latch 30 which may be driven manually.

Subsequently however, when the locking latch 30 is driven back to the unlocked position, the locking latch 30, as mentioned earlier, will first be pushed linearly until to such position where the locking latch 30 is free from restriction of pivotal movement. Then, the locking latch 30 is subsequently pushed to move pivotally as dictated by the surface profile of the second guiding edge 32 into the unlocked position, as mentioned earlier.

Take oven as an example, the operation of the power latch assembly 1 of present invention is as follows: when the motor assembly 20 is powered up by the oven, the driving shaft 211 thereof will drive the driving arm 22 as well as the actuation rotor 421 to rotate. As a consequence, the driving arm 22 is backwardly pulled along the guiding slot 14 in a linear manner. At the same time, the second slider end 112 of the locking slot 11 is arranged to guide the second guiding edge 32 of the locking latch 30 to move pivotally into the locking position along the locking slot 11. In other words, the griping head 35 is pivotally and linearly moved to engage with lock engaging slot 811 of the oven door the oven body so as to lock up the oven door to the oven body, as shown in FIG. 3A of the drawings.

At the time the driving arm 22 is driven to rotate, the actuation rotor 421 is as well driven to rotate for actuating the sensors 41 provided on the supporting base 11. Thus, the position of the locking latch 30 can be detected and a feedback signal, such as an electrical signal, will be transmitted to the motor assembly 20 for cutting off the power until a predetermined period of time or a change of state is accomplished as dictated by the oven. In other words, the locking latch 30 will remain in the locking position until the predetermined period of time is lapsed.

When the predetermined period of time is lapsed, or a change of state has occurred, the oven will then power the motor assembly 21 which restarts driving the driving arm 22 to rotate. Since the motion sensors 41 have been actuated once when the locking latch 30 is moving towards the locking position, the motor assembly 21 will then drive the locking latch 30 in the opposite direction so as to unlock the oven door. In other words, the driving arm 22 will then be pushed to pivotally and linearly push out the latching end 34 of the locking latch 30 towards the unlocked position, i.e. disengaging from the lock engaging slot 811 of the oven door, as shown in FIG. 3B of the drawings.

Thus, it can be shown that the present invention employs a simple yet strong structure for locking and unlocking the oven. It is important to point out that since the pivotal movement of the locking latch 30 is substantially dictated by the linear movement of the driving arm and the guided by the first and the second guiding edges 31, 32 of the locking latch 30, therefore, the present invention employs the minimum number of components for substantially and effectively controlling the locking and unlocking movement of the locking latch 30.

Figure 4A:
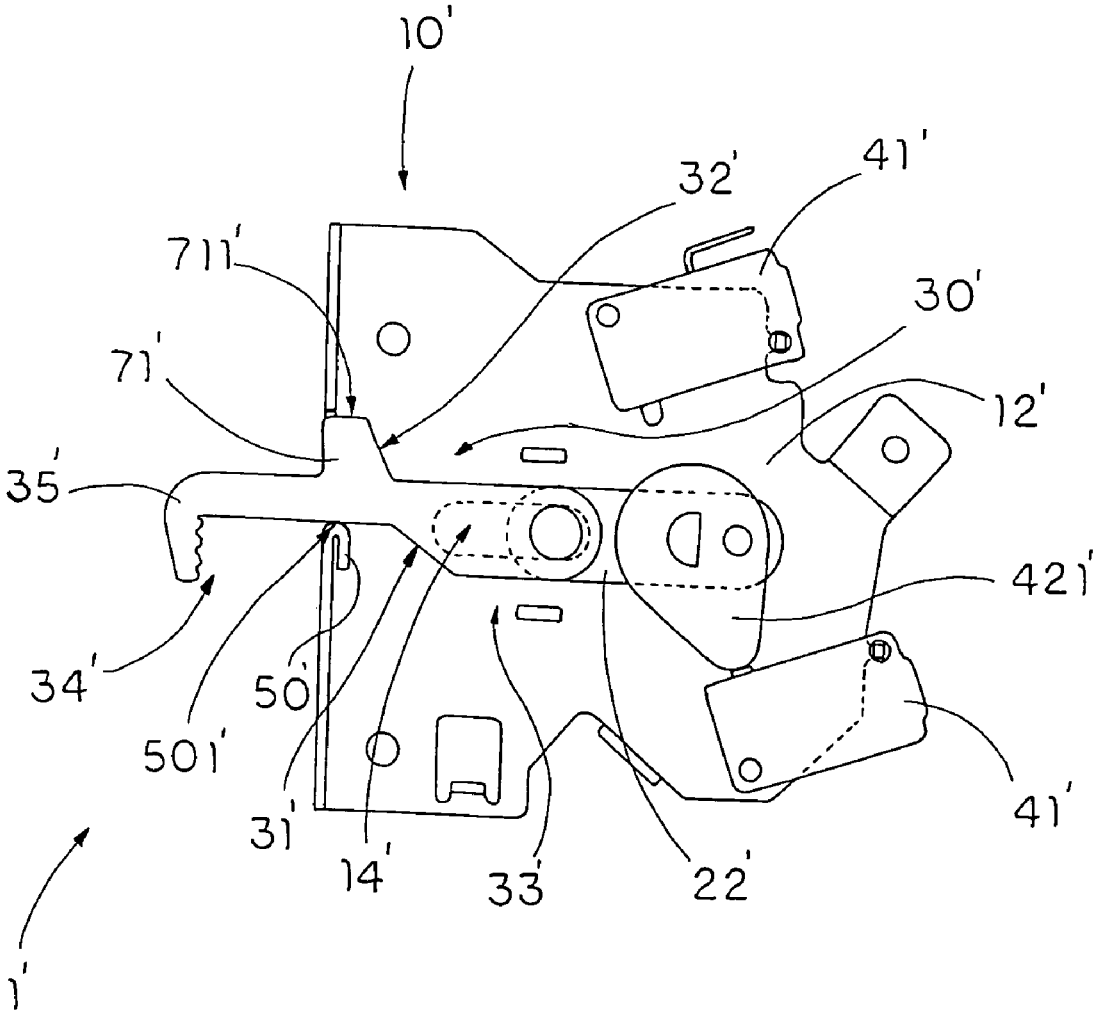
FIG. 4A and FIG. 4B are first alternative mode of the powered latch assembly according to the above first preferred embodiment of the present invention, illustrating that the guiding holder is replaced by an engaging member, illustrating that the locking latch is in the locking position and the unlocked position respectively.
Figure 4B:
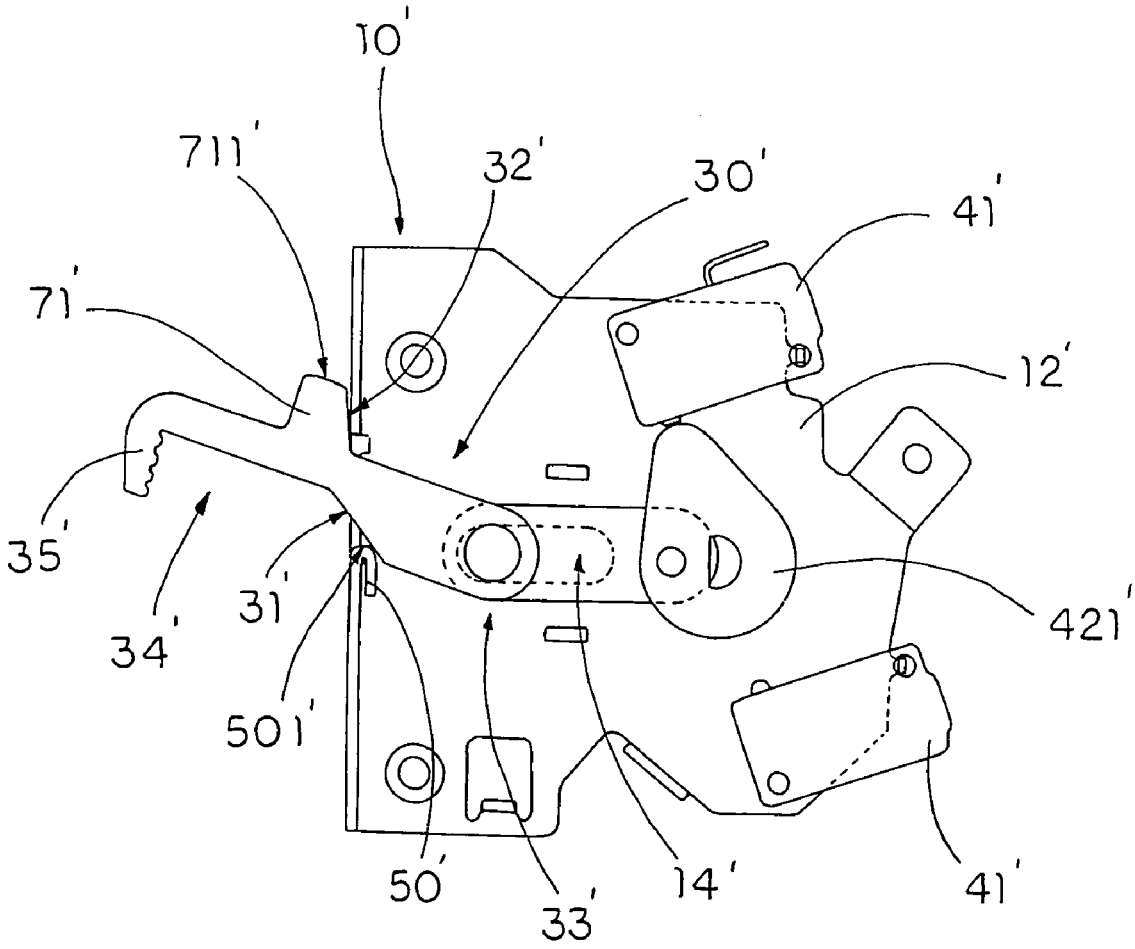

Referring to FIG. 4A and FIG. 4B of the drawings, a first alternative mode of the powered latch assembly 1' according to the first preferred embodiment is illustrated, in which the guiding holder 15 is replaced by an engaging member 50'. The engaging member 50', having a rounded surface 501' formed thereon, is provided on the locking slot 11' to form the first slider end 111' thereof. In other words, the rounded surface 501' of the engaging member 50' is adapted to guide the first guiding edge 31' of the locking latch 30' for efficiently moving between the locking position and the unlocked position. In other words, the rounded surface helps in substantially reducing the fiction between the first slider end 111' and the locking latch 30 for smoothening the locking operation.

Figure 5B:
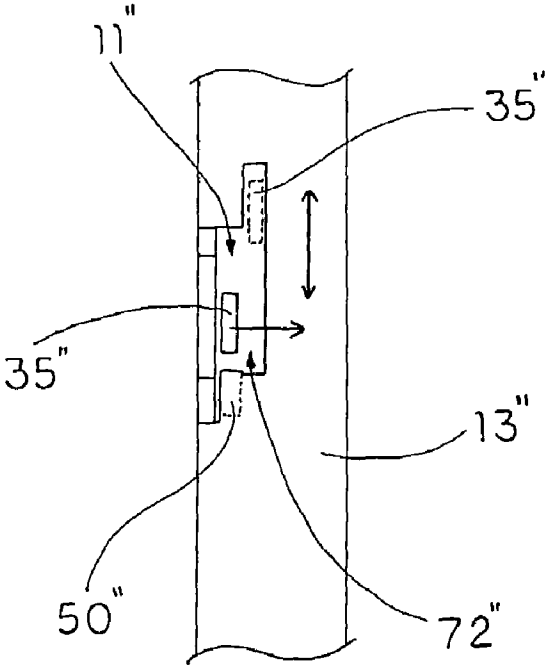
FIG. 5A and FIG. 5B is a second alternative mode of the powered latch assembly according to the above first preferred embodiment of the present invention, illustrating that the safety slot is formed adjacent to the locking slot for manual unlocking.
Figure 5A:
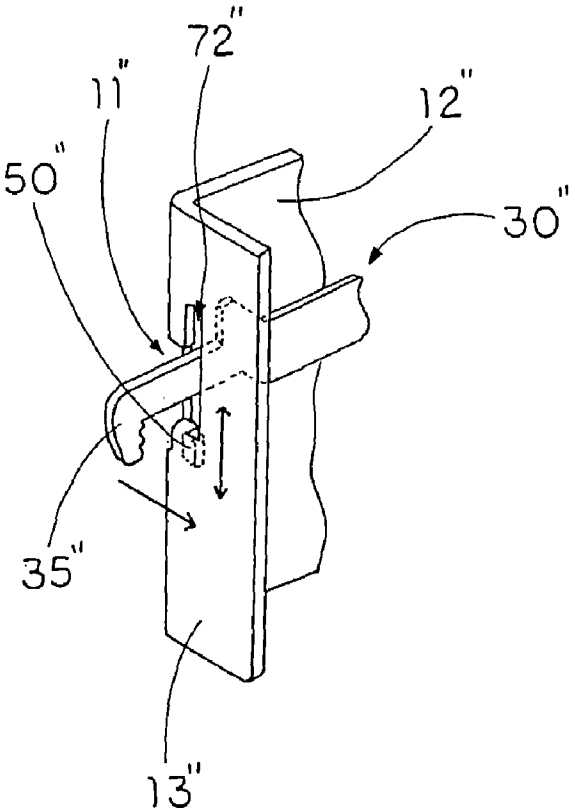

Referring to FIG. 5A and FIG. 5B of the drawings, a second alternative mode of the powered latch assembly 1" according to the above preferred embodiment of the present invention is illustrated, in which the safety device further contains a safety slot 72" formed adjacent and in parallel to the locking slot" and communicated thereto in such a manner that the locking latch 30" is adapted to be slightly pushed aside from the locking slot 11" to the safety slot 72" so that the biasing muscle 71" disaligns with the second slider end 112" of the locking slot 11". As a result, the locking latch 30" is adapted to be manually moved from the locking position to the unlocked position along the safety slot 72".

Thus one should appreciate that the safety slot 72" is provided in an attempt to remedy such situations as sudden power-off or any other accident whereby the door 81 is locked to the main housing 82, thus leaving the process taken place for the thing inside the main housing 82 uncontrolled. Hence, manual unlocking of the powered latch assembly 1" is available in this second alternative mode of the present invention.

In light of the above, it is worth mentioning that a combination of the above disclosed embodiment and the alternatives are possible and should be as well covered by the spirit of the present invention. For example, the safety slot 72" can be employed in the first preferred embodiment without replacing the guiding holder 15 by the engaging member 50'.

Figure 6:
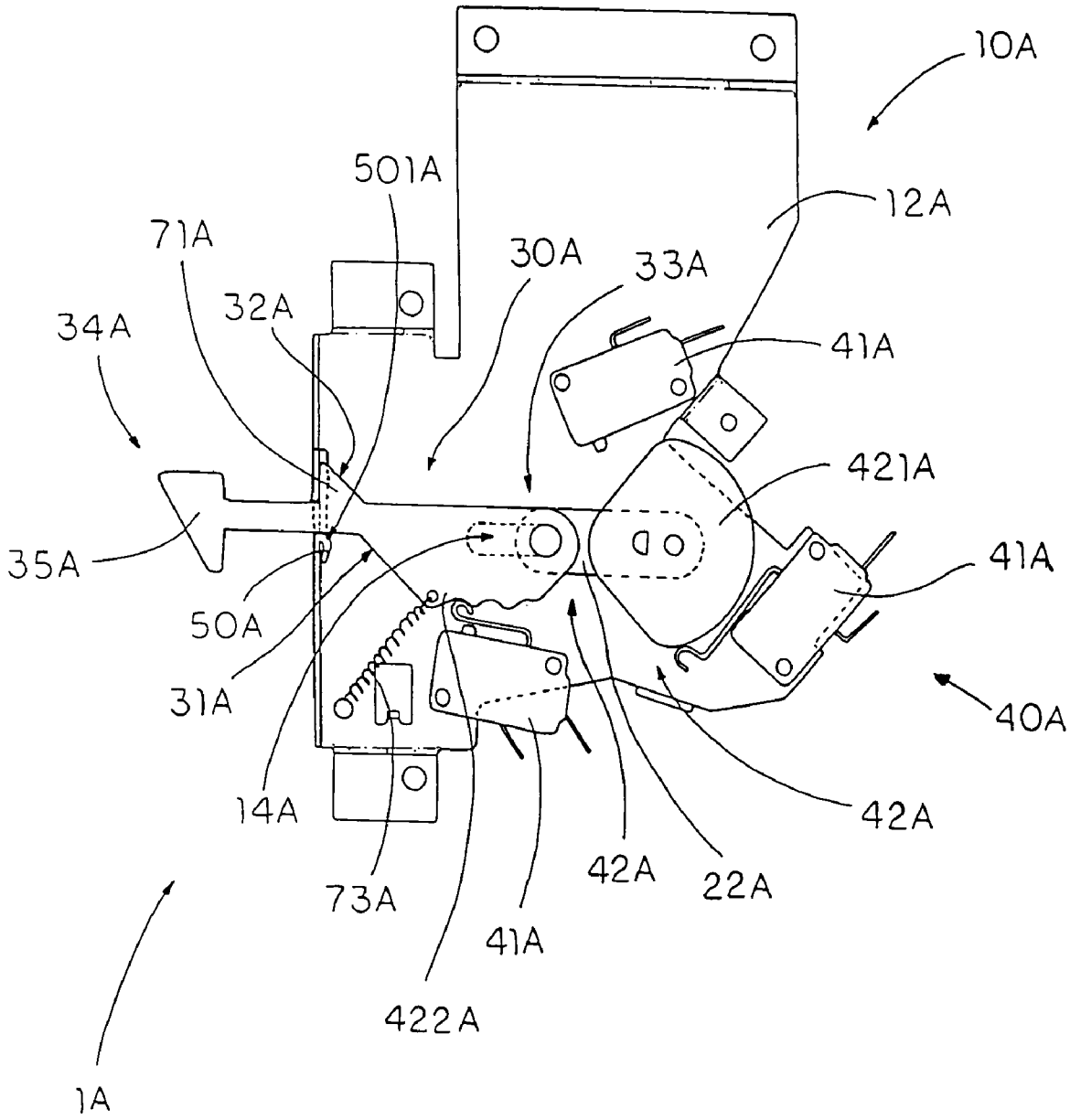
FIG. 6 is a schematic diagram of the powered latch assembly according to a second preferred embodiment of the present invention, illustrating that the locking latch is in the locking position.
Figure 7:
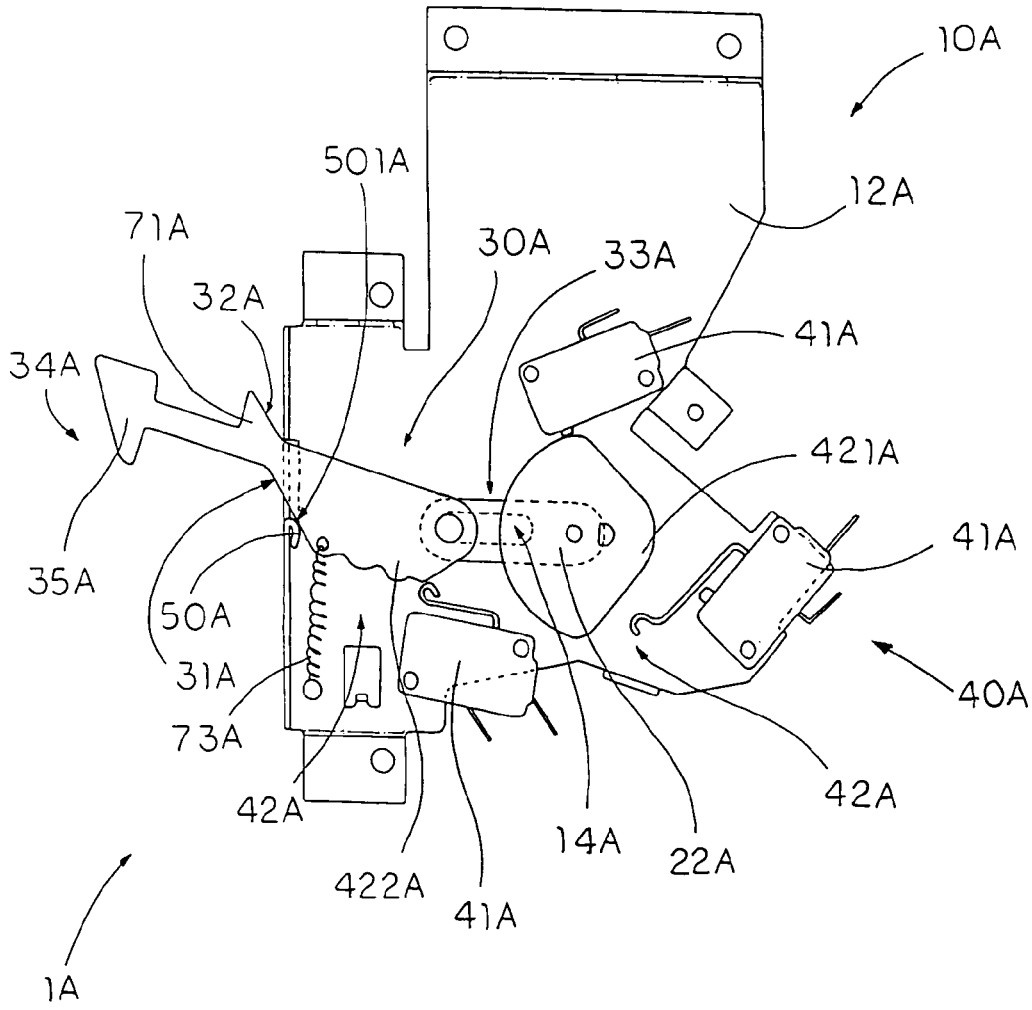
FIG. 7 is a schematic diagram of the powered latch assembly according to the above second preferred embodiment of the present invention, illustrating that the locking latch is in the unlocked position.

Referring to FIG. 6 and FIG. 7 of the drawings, a powered latch assembly 1A according to a second preferred embodiment of the present invention is illustrated. The second preferred embodiment is similar to the first preferred embodiment except the feedback device 40 and the safety device of the first preferred embodiment.

The feedback device 40A comprises at least one sensor 41A mounted on a predetermined position on the supporting base 12A and electrically connected to the power source, and a feedback actuation arrangement 42A provided on the supporting base 12A and operatively communicated with the locking latch 30A in such a manner that when the locking latch 30A is moved into a predetermined position, such as the locking position or the unlocked position, the sensor 41A will be actuated by the feedback actuation arrangement 42A and a feedback signal is sent to the power source.

The sensor 41A is preferably embodied as a regular motion sensor having a depressible button protruded therefrom, wherein when the depressible button is depressed, the sensor 41A is actuated to send a feedback signal to the power source.

Alternatively, the sensor 41A can be embodied as a conventional optical sensor wherein sensing light beam is continuously emitted therefrom in such a manner that when reflection pattern changes as a result of the movement of the locking latch 30A, the sensor 41A is then actuated by the feedback actuation arrangement 42A for generating a feedback signal to the power source.

It is worth mentioning that other forms of sensors may be employed for detecting and monitoring the position of the locking latch 30A.

According to the second preferred embodiment, the feedback actuation arrangement 42A comprises at least one protrusion actuator 422A outwardly and transversely protruded from a first guided portion of the locking latch 30A and arranged to actuate the sensor 41A when the locking latch 30A is linearly driven to move between the locking position and the unlocked position. In other words, at the time the locking latch 30A is driven to linearly move between the locking position and the unlocked position, the protrusion actuator 422A is then driven to move in the same manner to actuate the sensor 41A mounted in the predetermined position.

As a result, it is important to point out that a plurality of protrusion actuators 422A may be provided and outwardly protruded from the locking latch 30A for actuating the sensor 41A. Similarly, more than one sensor 41A may be provided and mounted on the supporting frame 12A in order to control the operation of the main fixture 82A and to finely monitor the position of the locking latch 30A.

Moreover, as in the case of the first preferred embodiment, the feedback actuation arrangement 42A can further comprise and an actuation rotor 421A rotatably connected with the driving axle 211A of the motor assembly 21A and outwardly extended from said driving axle 211A in such a manner that when the driving axle 211A is driven to rotate, the actuation rotor 421A is also driven to rotate for actuating the sensor 41A to generate the feedback signal.

Thus, the feedback device 40A allows for the following advantages: (i) use of a single sensor 41A such as but not limited to a three position switch to indicate the position of the locking latch 30A; (ii) more than one sensors 41A can be provided for independent actuation options; and (iii) where more than one sensors 41A are utilized, operations other then mere activation and turning off of the main housing, may be employed when the locking latch 30A is in different predetermined positions.

According to the second preferred embodiment of the present invention, the safety device comprises a resilient element 73A, such as a compressive spring, mounted on the supporting frame 12A for normally applying an urging force to the locking latch 30A so as to normally retain the locking latch 30A in a predetermined position, i.e. either the locking position or the unlocked position.

As shown in FIG. 6 of the drawings, when the locking latch is in the locking position, the biasing muscle 71A is arranged to be received in the supporting frame 10A, such that when power is suddenly cut off, the locking latch 30A is adapted to be unlocked manually by pivotally and linearly moving the locking latch 30A to the unlocked position. Since the resilient element 73A is normally applying an urging force to retain the locking latch 30A in its locking position, when the power is cut-off, the locking latch 30A will rest in the locking position until being manually unlocked.

In other words, a length of the locking slot 11A is larger than a width of the locking latch 30A so that it is capable of pivotally moving along the locking slot 11A.

Obviously, the alternative modes mentioned above may apply as well to the second preferred embodiment. For example, an alternative mode of the powered latch assembly 1' according to the second preferred embodiment is that the guiding holder 15A is replaced by an engaging member 50'.

Moreover, as a second example, for the first preferred embodiment, a resilient element 73A may be optionally mounted on the supporting frame 10" for normally applying an urging force to retain the locking latch 30" in the locking position. As a result, after the locking latch 30" is unlocked manually through the safety slot 72", the resilient element 73A is adapted to move the locking latch 30" back to the locking position.

To conclude, it can be shown that the objects of the present invention is substantially accomplished by the present invention.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A powered latch assembly for locking a door having a lock engaging slot to a main housing, comprising:

a supporting frame adapted for mounting on said main housing, wherein said supporting frame has a locking slot and defines first and second slider ends thereof;

a motor assembly comprising a power motor supported by said supporting base and adapted for being powered by said main housing, and a driving arm driven by said power motor in a linear movable manner; and a locking latch, defining a first guiding edge and a second guiding edge, having an inner coupling end coupling with said driving arm and an opposed latching end extended outwardly through said locking slot, wherein said driving arm linearly drives said locking latch moving between a locking position and an unlocked position;

wherein at said locking position, said first guiding edge of said locking latch is guided to slide on said first slider end of said locking slot to linearly and then pivotally move said locking latch to engage with said lock engaging slot of said door for locking up said door with said main housing, and at said unlocked position, said second guiding edge of said locking latch is guided to slide on said second slider end of said locking slot to linearly and then pivotally move said locking latch to disengage with said lock engaging slot of said door for unlocking said door with said main housing;

wherein said supporting frame further has a guiding slot longitudinally formed thereon, wherein said driving arm is slidably mounted on said guiding slot in said linearly movable manner so as to drive said locking latch to moving between said locking position and said unlocked position.

2. The powered latch assembly, as recited in claim 1, wherein said locking latch is elongated in shape wherein said first and said second guiding edges are inclindly formed on a first guided portion and a second guided portion of said locking latch respectively and adapted to guide said first and said second slider ends respectively for sliding along said locking latch in order to move between said locking position and said unlocked position, wherein a first and a second inclined angle for said first and said second guiding edges respectively dictate the extent to which said locking latch is to be linearly and pivotally moved, and a length of said locking slot limits a maximum possible pivotal movement of said locking latch.

3. The powered latch assembly, as recited in claim 2, further comprising a feedback device provided on said supporting frame and operatively communicated with said locking latch in such a manner that said feedback device is capable of monitoring and detecting a movement and a position of said locking latch respectively during moving between said locking position and said unlocked position.

4. The powered latch assembly, as recited in claim 3, wherein said feedback device comprises at least one sensor mounted on a predetermined position on said supporting base and electrically connected to said power source for communicating a feedback signal, and a feedback actuation arrangement provided on said supporting base and operatively communicated with said locking latch in such a manner that when said locking latch is moved into a predetermined position, said sensor is arranged to be actuated by said feedback actuation arrangement through said feedback signal.

5. The powered latch assembly, as recited in claim 4, wherein said locking latch further has a gripping head formed on said latch end of said locking latch and adapted for engaging with said lock engaging slot of said door when said locking latch is pivotally driven to said locking position so as to lock up said door with respect to said main housing.

6. The powered latch assembly, as recited in claim 5, further comprising a safety device comprising a biasing muscle outwardly, integrally and transversely extended from said second guided portion of said locking latch wherein said second guiding edge is formed on said biasing muscle for guiding said locking latch moving between said locking position and said unlocked position, wherein said biasing surface is arranged to align with said second slider end of said locking slot when said locking latch is in said locked position, so that manual unlocking of said locking latch is substantially prevented.

7. The powered latch assembly, as recited in claim 6, wherein a width of said sliding slot is slightly larger than a thickness of said locking latch such that a lateral movement between said locking latch and said supporting frame is substantially restricted for retaining said locking latch within said supporting frame.

8. The powered latch assembly, as recited in claim 7, wherein said supporting frame further comprises a guiding holder peripherally and detachably mounted on a side boundary of said locking slot to form said first and said second slider end.

9. The powered latch assembly, as recited in claim 8, wherein said feedback actuation arrangement comprises an actuation rotor rotatably connected with said driving axle of said motor assembly and outwardly protruded from said driving axle in such a manner that when said driving axle is driven to rotate, said actuation rotor is also driven to rotate for actuating said sensor to generate said feedback signal.

10. The powered latch assembly, as recited in claim 8, wherein said feedback actuation arrangement comprises at least one protrusion actuator outwardly and transversely protruded from said first guided portion of said locking latch and arranged to actuate said sensor when said locking latch is linearly driven to move between said locking position and said unlocked position.

11. The powered latch assembly, as recited in claim 9, wherein said feedback actuation arrangement further comprises at least one protrusion actuator outwardly and transversely protruded from said first guided portion of said locking latch and arranged to actuate said sensor when said locking latch is linearly driven to move between said locking position and said unlocked position.

12. The powered latch assembly, as recited in claim 7, wherein said supporting frame further comprises an engaging member, having a rounded surface, mounted on said locking slot to form said first slider end thereof, wherein said rounded surface of said engaging member is adapted to guide said first guiding edge of said locking latch moving linearly and pivotally between said locking position and said unlocked position.

13. The powered latch assembly, as recited in claim 12, wherein said feedback actuation arrangement comprises an actuation rotor rotatably connected with said driving axle of said motor assembly and outwardly protruded from said driving axle in such a manner that when said driving axle is driven to rotate, said actuation rotor is also driven to rotate for actuating said sensor to generate said feedback signal.

14. The powered latch assembly, as recited in claim 12, wherein said feedback actuation arrangement comprises at least one protrusion actuator outwardly and transversely protruded from said first guided portion of said locking latch and arranged to actuate said sensor when said locking latch is linearly driven to move between said locking position and said unlocked position.

15. The powered latch assembly, as recited in claim 13, wherein said feedback actuation arrangement further comprises at least one protrusion actuator outwardly and transversely protruded from said first guided portion of said locking latch and arranged to actuate said sensor when said locking latch is linearly driven to move between said locking position and said unlocked position.

16. The powered latch assembly, as recited in claim 6, wherein said safety device further contains a safety slot formed adjacent and in parallel to said locking slot and communicated thereto in such a manner that said locking latch is adapted to be slightly pushed aside from said locking slot to said safety slot so that said biasing member dis-aligns with said second slider end of said locking slot and is capable of being manually moved to said unlocked position.

17. The powered latch assembly, as recited in claim 16, wherein said safety device comprises a resilient element mounted on said supporting frame for normally applying an urging force to said locking latch so as to normally retain said locking latch in said locking position.

18. The powered latch assembly, as recited in claim 17, wherein said supporting frame further comprises an engaging member, having a rounded surface, mounted on said locking slot to form said first slider end thereof, wherein said rounded surface of said engaging member is adapted to guide said first guiding edge of said locking latch moving linearly and pivotally between said locking position and said unlocked position.

19. The powered latch assembly, as recited in claim 18, wherein said feedback actuation arrangement comprises an actuation rotor rotatably connected with said driving axle of said motor assembly and outwardly protruded from said driving axle in such a manner that when said driving axle is driven to rotate, said actuation rotor is also driven to rotate for actuating said sensor to generate said feedback signal.

20. The powered latch assembly, as recited in claim 18, wherein said feedback actuation arrangement further comprises at least one protrusion actuator outwardly and transversely protruded from said first guided portion of said locking latch and arranged to actuate said sensor when said locking latch is linearly driven to move between said locking position and said unlocked position.

21. The powered latch assembly, as recited in claim 17, wherein said supporting frame further comprises a guiding holder peripherally and detachably mounted on a side boundary of said locking slot to form said first and said second slider end.

22. The powered latch assembly, as recited in claim 21, wherein said feedback actuation arrangement comprises an actuation rotor rotatably connected with said driving axle of said motor assembly and outwardly protruded from said driving axle in such a manner that when said driving axle is driven to rotate, said actuation rotor is also driven to rotate for actuating said sensor to generate said feedback signal.

23. The powered latch assembly, as recited in claim 21, wherein said feedback actuation arrangement further comprises at least one protrusion actuator outwardly and transversely protruded from said first guided portion of said locking latch and arranged to actuate said sensor when said locking latch is linearly driven to move between said locking position and said unlocked position.

24. The powered latch assembly, as recited in claim 6, further comprising a safety device comprising a biasing muscle outwardly, integrally and transversely extended from said second guided portion of said locking latch wherein said second guiding edge is formed on said biasing muscle for guiding said locking latch moving between said locking position and said unlocked position, wherein said biasing muscle is arranged to extend outside said locking slot when said locking latch is in said unlocking position in such a manner that said locking latch is capable of manually and pivotally moving along said locking slot.

25. The powered latch assembly, as recited in claim 24, wherein said safety device comprises a resilient element mounted on said supporting frame for normally applying an urging force to said locking latch so as to normally retain said locking latch in said locking position.

26. The powered latch assembly, as recited in claim 25, wherein said supporting frame further comprises an engaging member, having a rounded surface, mounted on said locking slot to form said first slider end thereof, wherein said rounded surface of said engaging member is adapted to guide said first guiding edge of said locking latch moving linearly and pivotally between said locking position and said unlocked position.

27. The powered latch assembly, as recited in claim 26, wherein said feedback actuation arrangement comprises an actuation rotor rotatably connected with said driving axle of said motor assembly and outwardly protruded from said driving axle in such a manner that when said driving axle is driven to rotate, said actuation rotor is also driven to rotate for actuating said sensor to generate said feedback signal.

28. The powered latch assembly, as recited in claim 26, wherein said feedback actuation arrangement further comprises at least one protrusion actuator outwardly and transversely protruded from said first guided portion of said locking latch and arranged to actuate said sensor when said locking latch is linearly driven to move between said locking position and said unlocked position.

29. The powered latch assembly, as recited in claim 25, wherein said supporting frame further comprises a guiding holder peripherally and detachably mounted on a side boundary of said locking slot to form said first and said second slider end.

30. The powered latch assembly, as recited in claim 29, wherein said feedback actuation arrangement comprises an actuation rotor rotatably connected with said driving axle of said motor assembly and outwardly protruded from said driving axle in such a manner that when said driving axle is driven to rotate, said actuation rotor is also driven to rotate for actuating said sensor to generate said feedback signal.

31. The powered latch assembly, as recited in claim 29, wherein said feedback actuation arrangement further comprises at least one protrusion actuator outwardly and transversely protruded from said first guided portion of said locking latch and arranged to actuate said sensor when said locking latch is linearly driven to move between said locking position and said unlocked position.

* * * * *